United States Patent [19]

Schmitmeyer et al.

[11] 4,005,852

[45] Feb. 1, 1977

[54] TRACTION SHEAVE WARNING FOR HELICOPTER RESCUE HOIST SYSTEMS

[75] Inventors: Steven H. Schmitmeyer, Tipp City; James W. Strayer, New Carlisle, both of Ohio

[73] Assignee: The United States of America as represented by the Secretary of the Air Force, Washington, D.C.

[22] Filed: June 27, 1975

[21] Appl. No.: 590,881

[52] U.S. Cl. ..... 254/173 R; 73/136 A; 212/39 MS

[51] Int. Cl.[2] ..... B66D 1/48

[58] Field of Search ..... 254/173 R, 174, 186 R, 254/187 D, 190 R, 175.7; 73/116, 117, 136 A, 136 B; 212/39 MS

[56] References Cited

UNITED STATES PATENTS

| | | | |
|---|---|---|---|
| 3,015,473 | 1/1962 | Frellsen | 254/173 R |
| 3,352,152 | 11/1967 | Abraham | 254/173 R |
| 3,612,486 | 10/1971 | Martin et al. | 254/173 R |
| 3,698,243 | 10/1972 | Cline | 73/117 |
| 3,780,989 | 12/1973 | Peterson | 254/173 R |

FOREIGN PATENTS OR APPLICATIONS

| | | | |
|---|---|---|---|
| 1,149,873 | 9/1960 | Germany | 212/39 MS |
| 135,621 | 10/1961 | U.S.S.R. | 212/39 MS |

*Primary Examiner*—Frank E. Werner
*Assistant Examiner*—Kenneth Noland
*Attorney, Agent, or Firm*—Joseph E. Rusz; Arthur R. Parker

[57] ABSTRACT

A helicopter rescue hoist-traction sheave assembly including a hoist cable engaging sheave and first housing, a drive motor having a drive shaft mounting the sheave and a second housing mounting the motor and positioned in adjustable relation to the sheave housing, a rocker arm fixed to the motor-mounted housing, an alarm switch located near the rocker arm, and a torque compensating sping attached to, and normally retaining the rocker arm in a neutral position out of engagement with the switch when the drive motor is applying a normal amount of traction to the cable through the sheave and automatically moving the rocker arm to an engaged position with, and closing the switch in the event of a malfunction resulting in a substantial reduction in the motor-applied traction.

1 Claim, 3 Drawing Figures

TRACTION SHEAVE WARNING FOR HELICOPTER RESCUE HOIST SYSTEMS

RIGHTS OF THE GOVERNMENT

The invention described herein may be manufactured and used by or for the Government of the United States without the payment of any royalty.

BACKGROUND OF THE INVENTION

This invention relates generally to the field of helicopter-borne rescue hoist systems in which a malfunction-warning system is incorporated.

In the continued development of helicopter rescue hoist systems, one important problem has been the lack of a positive indication to the hoist operator when a malfunction has occurred, particularly in the traction sheave assembly portion of the overall hoist system. Such malfunctions may, for example, induce hoist cable slack, cable miswraps, and/or cable or total hoist system failure which could be detrimental or even fatal to the rescuee. Therefore, it becomes essential that the hoist operator be made immediately aware of precisely where a malfunction has occurred in the overall rescue hoist system, as for example, when there is slack in the hoist cable resulting in the fouling and/or snarling thereof. Of course, as a minimum, such malfunctions always result in cable damage sufficient to require the immediate replacement of the cable. Moreover, in an extreme case, catastrophic cable failure can occur which sometimes can also result in injury or even death to the personnel being rescued as noted hereinabove. Unfortunately, in a helicopter rescue hoist system under the most current development by the U.S. Government, a sheave warning light used therewith merely indicates whether or not electrical power is being applied to the traction sheave motor, and does not provide any indication of mechanical failures relating to the motor or traction sheave pulley assembly.

The unique warning light or malfunction-indicating alarm system of the present invention solves or, at least, substantially alleviates the foregoing problem by utilizing a torque-sensing mechanism to produce an effective, reliable, real-time and readily visible indication of any traction malfunction which could induce cable slack. In this regard, although the general concept of a torque sensing means is already broadly known, as is evidenced, for example, in U.S. Pat. Nos. 3,289,471 and 3,800,599, respectively issued on Dec. 6, 1966 and Apr. 2, 1974 to L. R. Maxwell and M. B. Goran, the torque sensing mechanism of the present invention is deemed to involve a new and improved combination that is integrated with a rescue hoist-traction sheave assembly in a novel and yet simplified manner, as will appear self-evident hereinafter in the following summary and detailed description.

SUMMARY OF THE INVENTION

The present invention consists in a new and improved traction sheave assembly for a helicopter rescue hoist system including a housing, a sheave, a hoist cable engaged over the sheave, a sheave drive motor coupled through a slipping clutch to the drive shaft mounting the sheave and being affixed to a second housing, in turn, bearing mounted to the sheave housing, a rocker arm affixed to the motor-attached housing, and a malfunction-operative switch located near the rocker arm and being in an electrical circuit with an alarm light.

A torque compensating spring is attached to and normally holds the rocker arm in a first, neutral position out of contact with the malfunction-operative switch so long as normal traction is being applied to the cable by the traction sheave, the latter action, of course, occurring during a rescue operation involving the lowering of the cable and the hoisting and thus rescue of a downed pilot, airman or other personnel. When, however, a malfunction occurs in the inventive sheave assembly, causing, for example, excessive slack in the hoist cable or the slippage thereof, the resulting reduced torque being applied to the sheave now automatically allows the torque compensating spring, which was previously in a balanced relation with the normal torque being applied, to effect a relative rotation between the bearing mounted, motor-attached housing and the sheave housing to thereby rotate the rocker arm, affixed to the said motor-attached housing, into an engaged position with, and thus close the malfunction-operative switch and its electrical circuit to the alarm light that may be easily located in a position near and made readily visible to the hoist operator, enabling the latter person to quickly institute appropriate remedial action. It is noted that, in place of the alarm light, a bell or both light and bell may be used, as desired.

Other objects and advantages of the invention will become readily apparent hereinafter in connection with the following disclosure, taken with the accompanying drawings, in which:

DESCRIPTION OF THE PREFERRED EMBODIMENT

Figure 1:
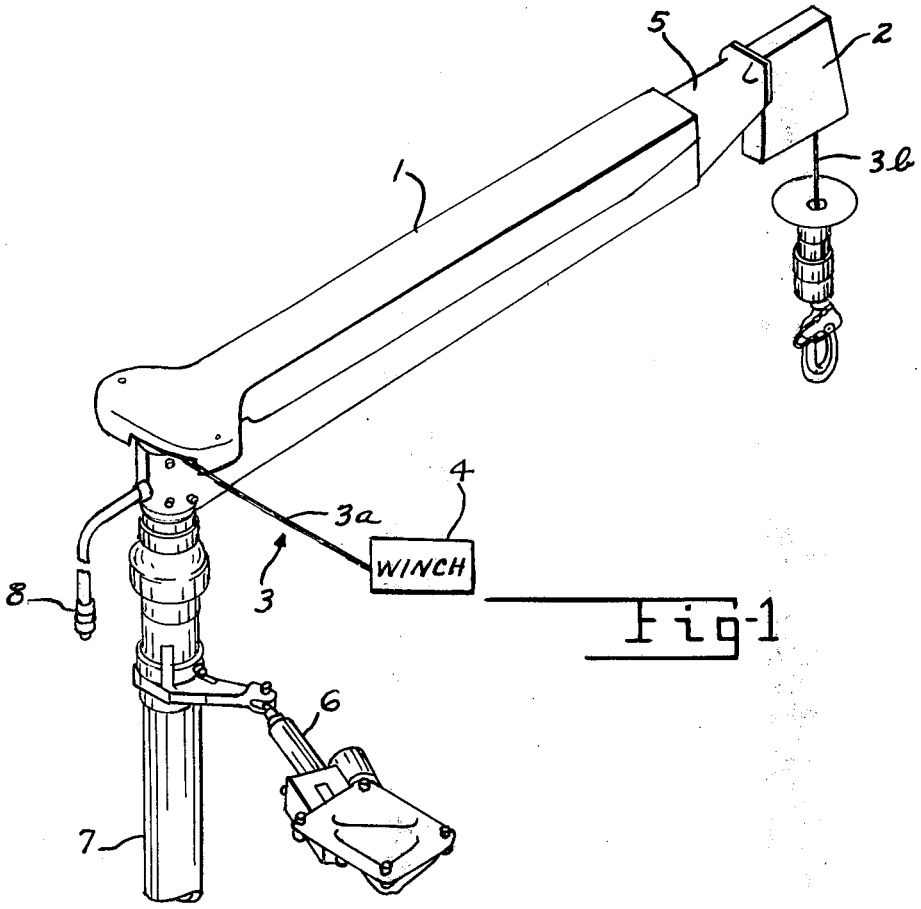
FIG. 1 is an overall schematic, assembly view, in perspective, of one type of helicopter rescue hoist system with which the new and improved traction sheave assembly of the present invention may be utilized.

Referring generally to the drawings and, in particular, to FIG. 1 thereof, one example of an overall helicopter hoist assembly with which the present invention may be integrated is indicated as including a hoist boom 1, a traction sheave assembly indicated generally at 2 and which will be further described in detail hereinafter as the new and improved combination of the present invention, a hoist cable 3 having an upper end **3*a* connected to a winch, indicated schematically at 4, and a lower hoist cable end, indicated at 3*b*, to which may be attached the rescuee to be hoisted. For this purpose, a standard hook bumper and hook with keeper may be attached in the usual manner to the lower end 3*b* of the hoist cable 3 as shown. A boom head 5 is used to attach traction sheave assembly 2 to the boom 1. The actuator for rotating the boom 1 between its stowed and operative, extended positions is indicated generally at 6, and a vertical column which may mount the boom 1 to the helicopter is shown at 7**.

The reference numeral 8 depicts an electrical connector for the cable used to supply power to the traction sheave motor and to provide a circuit to the alarm switch, which elements will be illustrated and described later.

Figure 2:
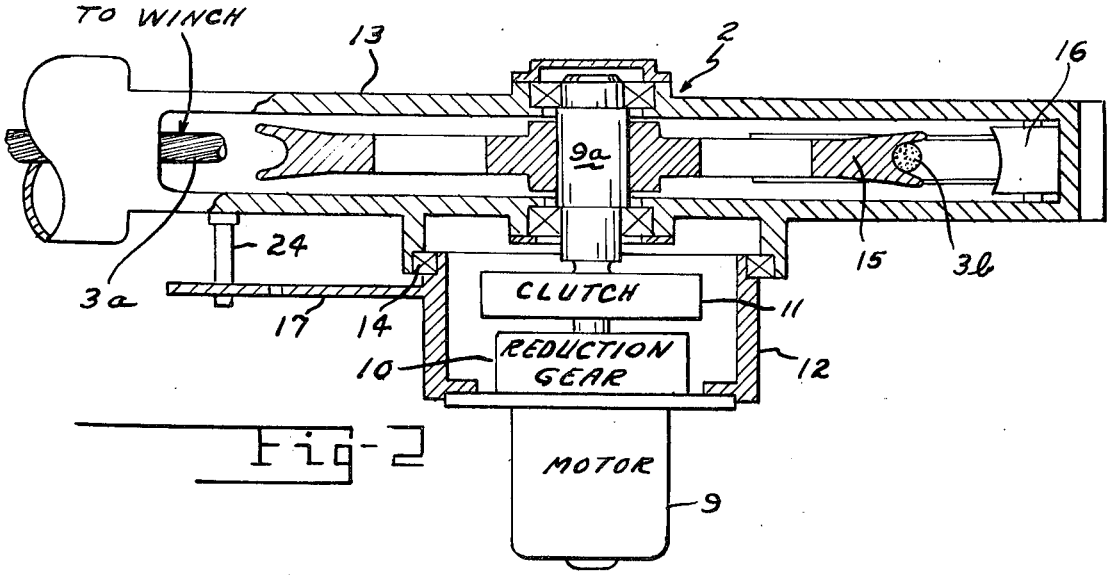
FIG. 2 is a partly broken-away, cross-sectional view, taken on line 2—2 of FIG. 3 and illustrating details of the novel torque sensing mechanism and malfunction-indicating means used with, and as integral part of the traction sheave assembly of FIG. 1.

With specific reference to FIG. 2, the new and improved traction sheave assembly 2 of the present invention is clearly illustrated as comprising a traction sheave drive motor 9 incorporating a reduction gear 10 both of which are mounted on and supported by housing 12. The motor-attached housing 12 may, as specifically taught by the present invention, be bearing mounted to a traction sheave housing 13, as by means of the bearing 14, to thereby enable relative rotation to take place therebetween, about the axis of shaft 9*a*, when a malfunction occurs, as will be further explained hereinafter. Said housing 13 encloses a traction sheave 15 that is fixed on shaft 9*a* and over which is fed the hoist cable 3, the upper and lower cable portions of which being indicated respectively at 3*a* and 3*b*, as previously noted. A guide roller 16 (Note also FIG. 3), may be utilized to limit the outward swing of the cable relative to sheave 15.

Figure 3:
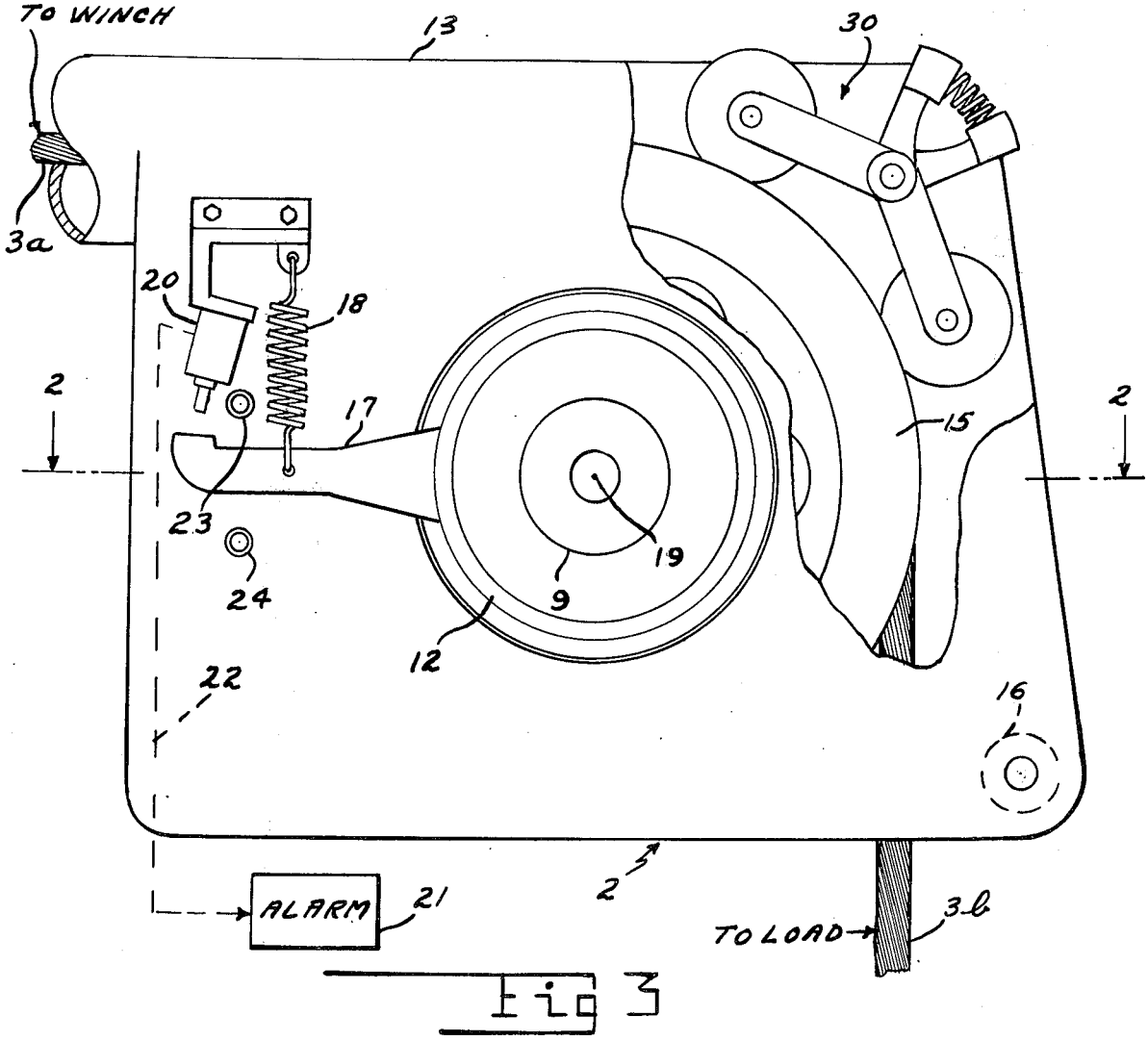
FIG. 3 is a second, partly broken-away and side-elevational view of the traction sheave assembly of FIGS. 1 and 2, showing additional details of the specific relationships between the torque sensing mechanism of the invention and the remainder of the inventive traction sheave assembly in unique combination therewith.

Motor 9, which is energized and runs continuously during operation of the hoist, continuously applies torque to shaft 9*a* and sheave 15 through a slipping clutch 11. The clutch may be of any suitable design, such as a friction disc between spring loaded pressure plates. The direction of the torque is clockwise (as seen in FIG. 3.). The motor 9 and its mounting 12, which are free to rotate about the axis 19 of shaft 9*a* as already noted, are restrained against a resulting counterclockwise rotation in a manner to be explained later. The purpose of the continuously applied clockwise torque is to maintain tautness at all times, and particularly in the absence of a load, in that part of the steel cable between the winch 4 and sheave 15. Any slackness at the winch may cause miswinds on the drum of the winch, jamming of the winch, and possible breakage of the cable. Maintaining the necessary cable tautness requires that the sheave have a firm, nonslipping, friction grip on the cable at all times. To insure this, the groove of the sheave may be coated with a friction material and pressure rollers 30 (FIG. 3) may be used to force the cable against the sheave. Although torque is constantly applied to sheave 15, the sheave should turn only when cable is being paid out or taken up by the winch, the direction of rotation being with the applied torque when cable is paid out and against the applied torque when cable is taken up.

As is seen more clearly in FIG. 3 and in accordance with the further novel teachings of the present invention, the rotatable, motor-attached housing 12 is uniquely equipped with a rocker arm 17, which arm is rigidly affixed to, and extends outwardly in transverse relation from, the outer circumference of the said housing 12. During operation of the present hoist assembly, a torque counterbalancing spring 18 normally retains the rocker arm 17 in a neutral position about midway of stops 23 and 24, as seen in FIG. 3, so long as normal traction is being applied to the cable by the sheave 15 and drive motor 9. If, however, as a result of a malfunction, such as loss of power at motor 9 or loss of grip on the cable by sheave 15, the traction being so applied to the cable should drop to zero or be reduced to an undesirably low value, the torque counterbalancing spring 18, which normally exerts a force on rocker arm 17 that balances the traction being applied to the cable by the sheave 15 when no malfunction is occurring, would then become automatically operative, against the now reduced counterclockwise force on arm 17, to move the arm 17 and the attached housing 12 about the pivot axis 19 in a clockwise direction, as viewed in FIG. 3, to an engaged position with switch 20.

Explaining more pecisely the above operation, under normal stable conditions with adequate traction being applied to the cable by sheave 15 and arm 17 stationary at a point intermediate stops 23 and 24, the following relationship holds:

$$F = \frac{r}{r'} T \qquad (1)$$

where $F$ = force exerted against spring 18 by arm 17
$T$ = traction applied to the cable by sheave 15
$r$ = effective radius of sheave 15 $r'$ = distance from sheave axis 19 to the point of attachment of spring 18 to arm 17.

Since both $r$ and $r'$ are constants, equation (1) may be written as $$F = kT \qquad (2)$$

Under these conditions, the force F is exactly balanced by the opposite force exerted by spring 18. As shown by equation (2), anything that reduces T results in a proportionate reduction in F and a movement of arm 17 upward (clockwise) under the now superior force of spring 18 until the spring force has been reduced to equality with the lower value of F, at which point the system is again in balance. Further reductions in T cause arm 17 to move further upward until, when T has fallen below a design minimum, switch 20 is actuated. A reduction in T may occur as the result of loss of power at motor 9 or slippage of sheave 15 on the cable. Loss of power of course reduces T and F to zero causing arm 17 to be immediately rotated upward by spring 18 closing switch 20. If the degree of slippage at sheave 15 is sufficient to reduce T below the above mentioned design minimum, arm 17 is likewise rotated upward by the spring to close switch 20.

Closure of switch 20 energizes, through the circuit 22, an alarm light 21 located in the helicopter at a position readily visible to the hoist operator to enable the latter to take any appropriate corrective action. Both electrical circuit 22 and alarm light 21 are shown in schematic form only, since the specific details thereof are unimportant to the novel traction sheave assembly of the present invention. Of course, by specifically bearing mounting the motor-attached housing 12 to the sheave housing 13 to thereby enable relative rotational movement therebetween in the event of a malfunction, the previously-described rotation of the rocker arm 17 to engage and close the malfunction-operative switch 20 is thus specifically assured by the unique traction sheave assembly of the instant invention. In this connection, the pair of spaced-apart relatively elongated, rod or bar members, at 23 and 24, are used to limit the clockwise and/or counterclockwise rotation of the yoke arm 17, as is seen more particularly in FIG. 3.

Thus, a new and improved helicopter rescue hoist-traction sheave assembly has been developed whereby the traction sheave drive motor may be attached to a housing that is rotatively adjusted relative to the traction pulley and is placed in a unique and yet relatively simplified combined torque compensating and malfunction-warning light system comprised merely of a yoke arm fixed to the motor-attached housing a malfunction-operative switch located near the yoke arm, and a torque compensating spring attached to, and moving the yoke arm between a neutral position when normal torque is being applied to the sheave and an engaged position with the switch to operate the warning light when the traction being applied to the cable by the sheave is significantly reduced by a malfunction in the traction sheave assembly. Of course, in place of the warning light, or as a supplement thereto, a bell or other clearly audible signal might be used, as desired.

We claim:

1. In a hoist employing a winch and cable, a traction sheave mechanism for maintaining tautness in the cable at the winch, particularly in the absence of a cable load, said mechanism comprising: a traction sheave housing; a traction sheave attached to a shaft rotating in bearings in said housing, said traction sheave frictionally engaging the cable from the winch; a motor support structure mounted on said sheave housing by means of a bearing permitting rotation of the support structure about the axis of said shaft; a motor mounted on said support structure; means including a slipping clutch for coupling the motor to said shaft for continuously applying a torque to said sheave in the direction to tension the cable between the sheave and the winch; a spring attached to said sheave housing and to said support structure for exerting a rotational force on the support structure that counterbalances the normal traction applied to the cable by the sheave; and means responsive to a rotation of said support structure relative to said sheave housing by a predetermined amount in the direction of said spring force to actuate an alarm signalling a low value of sheave traction on said cable.

* * * * *